US005243915A

United States Patent [19]

Paech

[11] Patent Number: 5,243,915

[45] Date of Patent: Sep. 14, 1993

[54] DROPPABLE MINE

[75] Inventor: Joachim Paech, Erkrath, Fed. Rep. of Germany

[73] Assignee: Rheinmetall GmbH, Ratingen, Fed. Rep. of Germany

[21] Appl. No.: 828,813

[22] PCT Filed: Jun. 25, 1991

[86] PCT No.: PCT/EP91/01179

§ 371 Date: Jun. 28, 1992

§ 102(e) Date: Jun. 28, 1992

[87] PCT Pub. No.: WO92/07232

PCT Pub. Date: Apr. 30, 1992

[30] Foreign Application Priority Data

Oct. 15, 1990 [DE] Fed. Rep. of Germany ..... 4032631

[51] Int. Cl.[5] ..... F42B 23/24

[52] U.S. Cl. ..... 102/425; 102/401

[58] Field of Search ..... 102/401, 411, 424, 425, 102/428, 408, 400, 387

[56] References Cited

U.S. PATENT DOCUMENTS

| | | | |
|---|---|---|---|
| 4,196,668 | 4/1980 | Morlock et al. | 102/401 |
| 4,292,861 | 10/1987 | Thornhill et al. | 102/401 |
| 4,304,186 | 12/1981 | Fischer et al. | 102/401 |
| 4,807,904 | 10/1989 | Picot | 102/387 |
| 4,922,824 | 5/1990 | Schubart | 102/387 |
| 4,934,274 | 6/1990 | Mathey | 102/401 |
| 4,969,398 | 11/1990 | Lundwall | 102/401 |

FOREIGN PATENT DOCUMENTS

| | | |
|---|---|---|
| 0296382 | 12/1988 | European Pat. Off. . |
| 3127071 | 1/1983 | Fed. Rep. of Germany . |
| 3509282 | 9/1986 | Fed. Rep. of Germany . |

*Primary Examiner*—David H. Brown

*Attorney, Agent, or Firm*—Spencer, Frank & Schneider

[57] ABSTRACT

In known droppable mines it customarily becomes necessary, because of the consistency and slope of the ground, to right the mine into a position favorable for its action, with such a position being fixable, if possible, for the entire duration of deployment independently of extraneous influences.

Since in the past such fixing was realized in the known mines only in a complicated and unsatisfactory manner, the mine (10) according to the invention includes a sack (18) which is arranged below a righting balloon (16) and is filled with a hardenable foam. In this way, the stability of the mine (10) is decisively improved. Due to the underside (22) of the sack (18) being kept permeable, the foam is also able to escape into a zone (34) between the ground (12) and the sack (18) and cause the mine (10) to adhere to the ground (12) in its position.

12 Claims, 1 Drawing Sheet

DROPPABLE MINE

BACKGROUND OF THE INVENTION

The invention relates to a droppable mine having mine housing and a righting balloon surrounding its circumference so as to right and position the mine housing, as well as a fixing device for fixing the mine housing on the ground in a desired position.

Such droppable mines are increasingly deployed by launching from the ground or from the air into a certain target area. Customarily, various carrier systems are employed for this purpose such as, for example, rockets, artillery projectiles or the like.

After being ejected from the carrier system, the mines generally drop to the ground in a decelerated fashion so that even if the landing surface is soft, the mines do not sink into the ground. Since, in view of the usual consistency of the ground and its slope, it can hardly ever be assumed that such mines land on the ground in a position that is advantageous for their action, particularly in connection with so-called intelligent mines, it is necessary to put them upright and position them for efficient action.

It is known to right such mines by providing a balloon that surrounds the mine housing over its circumference and to blow it up by suitable measures to thus enable the mine to be put upright.

Since, however, this upright position of the mine should be ensured also over longer periods of deployment independently of the consistency of the ground, the weather and possible shocks, the more recent development of such mines provides for fixing them in their upright position.

However, because of their special configuration, prior art fixing devices for such mines, such as, for example, fixing nails driven out of the mine housing into the ground, are not suitable for all types of ground and, because of their structural size, are not suitable for flat mine housings but only for high mine housings.

It is therefore the object of the invention to provide a droppable mine of this type which includes a fixing device that is distinguished by a low structural height and suitability for all types of ground.

SUMMARY OF THE INVENTION

The above object is accomplished according to the present invention by a droppable mine of the above described type wherein the fixing device is composed of a foam generator for generating a hardenable foam, a sack disposed at the underside of the mine housing, and conduits for supplying the foam generated by the foam generator to the sack to fill the sack.

The fixing device provided according to the invention and composed of a sack attached to the underside of the mine housing so as to be filled with a hardenable foam once the mine has been righted can be realized in a simple manner and requires only a small structural volume, particularly a low structural height, and can thus be employed even in flat mine housings.

Further advantageous features of the invention are disclosed and described.

The invention will be described and explained below with reference to a drawing figure in which components that are not significant to the invention have not been illustrated.

BRIEF DESCRIPTION OF THE DRAWINGS

It is shown in.

DETAILED DESCRIPTION OF THE PREFERRED EMBODIMENTS

Figure 1:
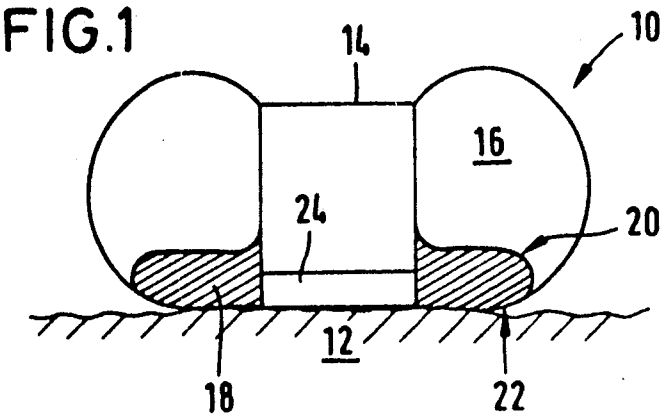
FIG. 1 is a schematic side view of a droppable mine according to the invention after it has been righted on planar ground.

FIG. 1 depicts a droppable mine 10 according to the invention which has already landed in the target area on the ground 12 existing there. On the side around a mine housing 14 for the mine 10, an already deployed, that is, blown-up righting balloon 16 is shown. This righting balloon 16 is known per se and operates in the conventional manner similarly to an air bag in an automobile.

In the lower region and around the mine housing 14, an unfoldable sack 18 is disposed which, as shown here, can be filled by a hardenable foam, for example polyurethane foam, and thus serves as a fixing device for the mine 10 on ground 12. Preferably, sack 18 is composed of a portion forming a topside 20 and a portion forming an underside 22, each made of a textile material, with topside 20 being composed of a dense, impermeable fabric and the underside 22 of a fabric that is partially permeable for the foam. The foam itself which fills sack 18 is generated in a foam generator 24 as shown schematically in FIG. 1. This foam generator will be described and explained in greater detail below in connection with the description of FIG. 4.

As shown in FIG. 1, sack 18 is preferably integrated in the righting balloon 16.

In order to ensure sufficient stability even if there are unfavorable changes in climate and also against shocks in ground 12, sack 18 is configured in such a way that, when filled, it preferably forms a ring (FIG. 1), a disc (FIG. 4) or a structure having leg-like extensions.

Figure 2:
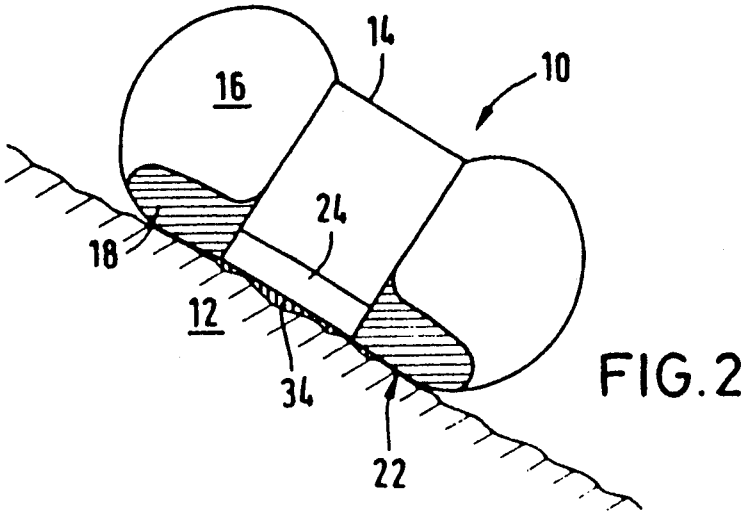
FIG. 2 is a schematic side view of a droppable mine according to the invention on a sloped ground (slope position)

FIG. 2 shows the mine 10 according to the invention as shown in FIG. 1 in a position on a sloped ground 12, with the mine housing 14 in its position on a slope also being reliably supported and thus fixed in its position by the foam filled sack 18. The stability of mine 10 is additionally improved in that foam escapes through the underside 22 of sack 18, which is partially permeable to the foam, and enters into a space 34 (see also FIGS. 2 and 3) between sack 18 (its underside 22) and the ground 12 and thus glues mine 10 to the ground 12.

Figure 3:
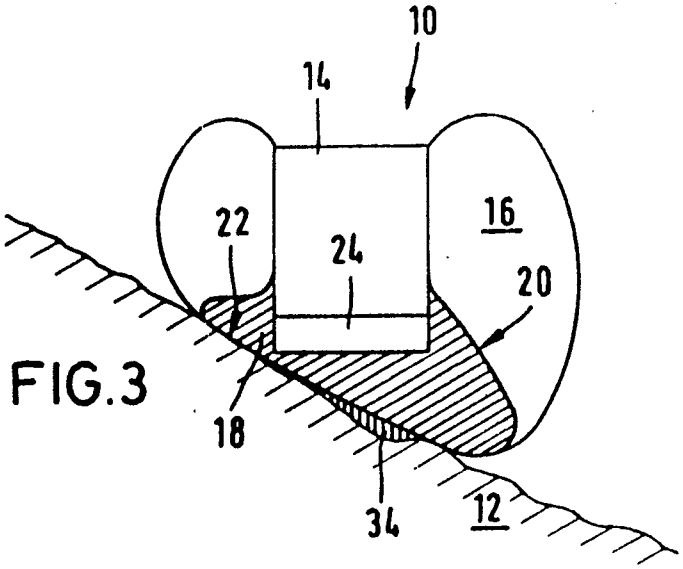
FIG. 3 is a schematic side view of a droppable mine according to the invention after it has been righted and the mine body has been oriented vertically on a slope.

In FIG. 3, the mine 10 according to the invention is likewise shown in a position on a slope. In this case, mine housing 14 has been brought into a vertical position by means of suitable, known measures. When pressed into sack 18, the foam generated in foam generator 24 is able to creep under mine housing 14 and, after hardening, fixes the vertical position of mine 10. Here again, the foam escaping through the porous underside 22 of sack 18 serves as an additional adhesive to hold mine 10 on the ground 12 and thus to improve its stability.

Figure 4:
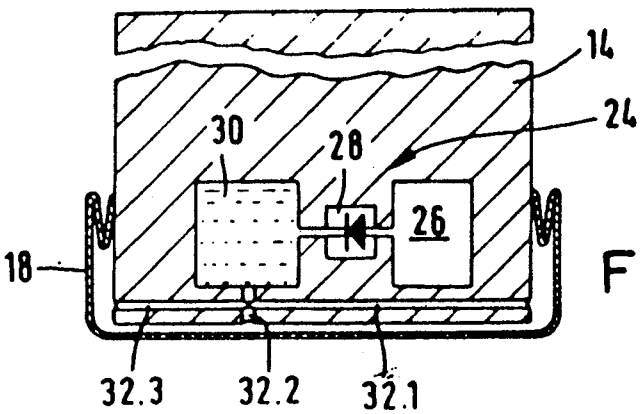
FIG. 4 is a schematic cross-sectional illustration of a droppable mine with a foam generator according to the invention.

FIG. 4 shows a preferred embodiment of the foam generator 24 in mine housing 14. A highly tensioned gas generated or disposed in a gas generator 26 which, however, also may be a gas reservoir is released through a valve marked 28 that is controlled by an electronic unit of the mine not shown here and reaches a reservoir vessel 30 which contains a foam forming liquid, preferably polyurethane. The thus produced foam is pressed from reservoir 30 through suitable conduits 32.1, 32.2 and 32.3 into the sack 18 that surrounds the underside of mine housing 14 and is fastened thereto. Sack 18 is filled in the manner shown in FIGS. 1 to 3 and hardens after a time determined by the composition of the foam forming liquid and the gas. As already mentioned above, a small quantity of foam is able to escape from the partially permeable fabric of the underside 22 of sack 18 and thus additionally fix mine 10 on the ground 12.

I claim:

1. Droppable mine including: a mine housing; means, including a balloon surrounding the circumference of said mine housing, to right and position the mine housing; and a fixing device for fixing the mine housing on the ground in a desired position, said fixing device being composed of a foam generator for generating a hardenable foam, a sack disposed at the underside of the mine housing, and conduits for supplying the foam generated by the foam generator to the sack to fill the sack.

2. A mine according to claim 1, wherein the sack is integrated in said balloon.

3. A mine according to claim 1, wherein the sack is shaped such that, in its filled state, it forms a ring.

4. A mine according to claim 3, wherein said sack is integrated in said balloon.

5. A mine according to claim 1, wherein the sack is shaped such that, in its filled state, it forms a disc.

6. A mine according to claim 2, wherein said sack is integrated in said balloon.

7. A mine according to claim 1, wherein the sack is shaped such that, in its filled state, it extends laterally.

8. A mine according to claim 7, wherein said sack is integrated in said balloon.

9. A mine according to claim 1, wherein the sack is composed of a portion forming its topside and of a portion forming its underside for resting on the ground.

10. A mine according to claim 9, wherein said sack is integrated in said balloon.

11. A mine according to claim 9, wherein the topside of the sack is manufactured of a dense, impermeable fabric and the underside of a fabric that is partially permeable for the foam.

12. A mine according to claim 11, wherein said sack is integrated in said balloon.

* * * * *